US006435632B1

(12) United States Patent
Correa

(10) Patent No.: US 6,435,632 B1
(45) Date of Patent: Aug. 20, 2002

(54) MODULAR FRONT PANELS

(75) Inventor: Juan Carlos Carne Correa, Porto Alegre (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/485,754

(22) PCT Filed: Jun. 22, 1998

(86) PCT No.: PCT/BR98/00034

§ 371 (c)(1),
(2), (4) Date: Feb. 15, 2000

(87) PCT Pub. No.: WO99/67578

PCT Pub. Date: Dec. 29, 1999

(51) Int. Cl.[7] ..... A47B 77/08
(52) U.S. Cl. ..... 312/236; 312/265.5
(58) Field of Search ..... 312/263, 236, 312/205, 257.1, 235.6, 265.5

(56) References Cited

U.S. PATENT DOCUMENTS

| | | | | | |
|---|---|---|---|---|---|
| 2,257,536 | A | * | 9/1941 | Roycroft | 312/263 |
| 2,807,026 | A | * | 9/1957 | Muskin et al. | 312/263 |
| 3,012,835 | A | * | 12/1961 | Anderson et al. | 312/205 |
| 4,570,814 | A | | 2/1986 | Seeley | |

FOREIGN PATENT DOCUMENTS

| | | | | |
|---|---|---|---|---|
| DE | 2321197-a | * | 11/1973 | 312/263 |
| GB | 2069767 | | 8/1981 | |
| GB | 2103774 | | 2/1983 | |

* cited by examiner

*Primary Examiner*—Peter M. Cuomo
*Assistant Examiner*—Jerry A. Anderson

(57) ABSTRACT

A modular panel for forming part of an enclosure for an appliance of the type which is manufacturable in a plurality of sizes requiring one or more modular panels. The panel includes a main planar section having first and second substantially parallel edges. First and second flanges are integrally formed with the main section and extend rearwardly from the first and second edges, respectively. The first and second flanges are parallel to one another and each has an inner and outer facing surface. The outer facing surface of the first flange is provided with integrally formed hinge elements which together define a first axis. The outer surface of the second flange is provided with integrally formed mating hinge elements spaced from one another the same distance as the first hinge elements and together defining a second axis parallel to the first axis. The second hinge elements are configured to engage the first hinge elements of a second modular panel in a manner which causes the first and second axes to become coincident and allows pivotal movement of the two panels with respect to one another about the coincident axes until the outer surfaces of the flanges are in confronting relation with one another. Interacting means are provided for interconnecting the confronting outer surfaces with one another.

2 Claims, 8 Drawing Sheets

MODULAR FRONT PANELS

TECHNICAL FIELD

The invention generally relates to air distribution units of the type commonly used in air conditioning, heating or ventilation systems and more particularly to panels forming an outer cover for such a unit.

BACKGROUND ART

In many commercial air conditioning, heating and ventilating systems, treated air is discharged into an area to be conditioned through an air distribution or conditioning unit. For example, one general type of air conditioning system, often referred to as a split system, includes separate indoor and outdoor units. The outdoor unit includes a compressor, a heat exchanger and a fan. The indoor unit includes a heat exchanger and a fan. In operation, the indoor fan draws air into the indoor unit, through an inlet thereof, and forces the air over the indoor heat exchanger and then out of the indoor unit, through an outlet opening therein.

The outdoor fan draws air into the outdoor unit, through an inlet, forces that air over the outdoor heat exchanger and then forces that air out of the outdoor unit through an outlet therein. At the same time, a compressor causes a refrigeration fluid to circulate through and between the indoor/outdoor heat exchangers. At the indoor heat exchanger, the refrigerant absorbs heat from the air passing over that heat exchanger, cooling that air. At the same time, at the outdoor heat exchanger, the air passing over the heat exchanger absorbs heat from the refrigerant passing therethrough.

Split type air conditioning units of this type are typically manufactured in a wide range of cooling capacities. Accordingly, the size of the indoor unit may range from a small compact relatively narrow unit up to a unit which may be many times wider than the compact unit. Regardless of what the width is, however, the wider units are substantially the same height as the compact unit.

In manufacturing such units, particularly as the units become larger, the fabrication of certain components, such as those comprising the front cover portion of the unit, become onerous and cumbersome in size. Such large size results in components which are difficult to manufacture and difficult to handle, both during manufacture and assembly of the units. Further, when such components are made from molded plastic, each requires a separate mold which increases costs substantially for a range of product sizes.

DISCLOSURE OF THE INVENTION

A modular panel for forming part of an enclosure for an appliance of the type which is manufacturable in a plurality of sizes requiring one or more modular panels. The panel includes a main planar section having first and second substantially parallel edges. First and second flanges are integrally formed with the main section and extend rearwardly from the first and second edges, respectively. The first and second flanges are parallel to one another and each has an inner and outer facing surface. The outer facing surface of the first flange is provided with integrally formed hinge elements which together define a first axis. The outer surface of the second flange is provided with integrally formed mating hinge elements spaced from one another the same distance as the first hinge elements and together defining a second axis parallel to the first axis. The second hinge elements are configured to engage the first hinge elements of a second modular panel in a manner which causes the first and second axes to become coincident and allows pivotal movement of the two panels with respect to one another about the coincident axes until the outer surfaces of the flanges are in confronting relation with one another. Interacting means are provided for interconnecting the confronting outer surfaces with one another.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
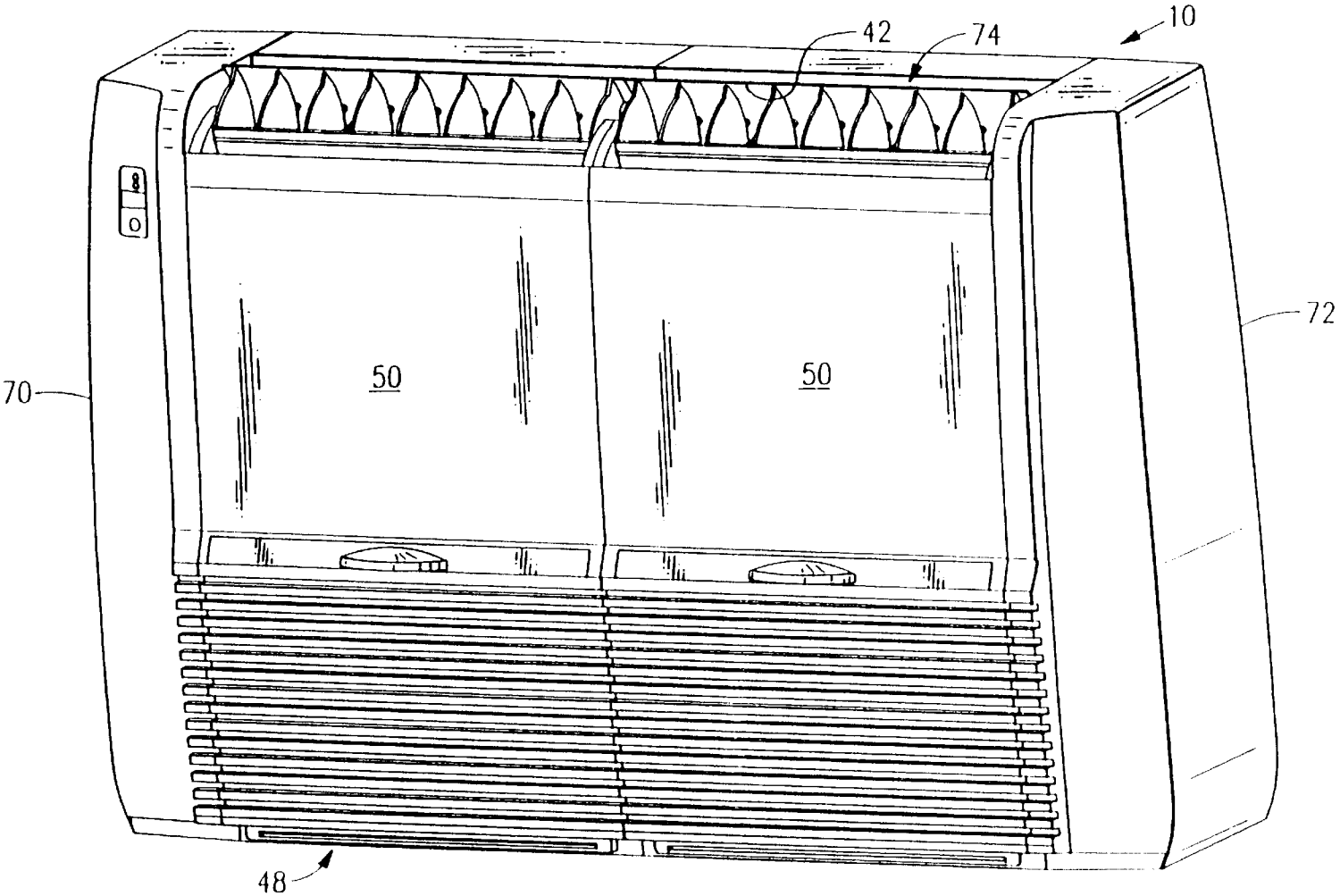
FIG. 1 is a perspective view of the indoor unit of an air conditioner which embodies the features of the present invention.
Figure 10:
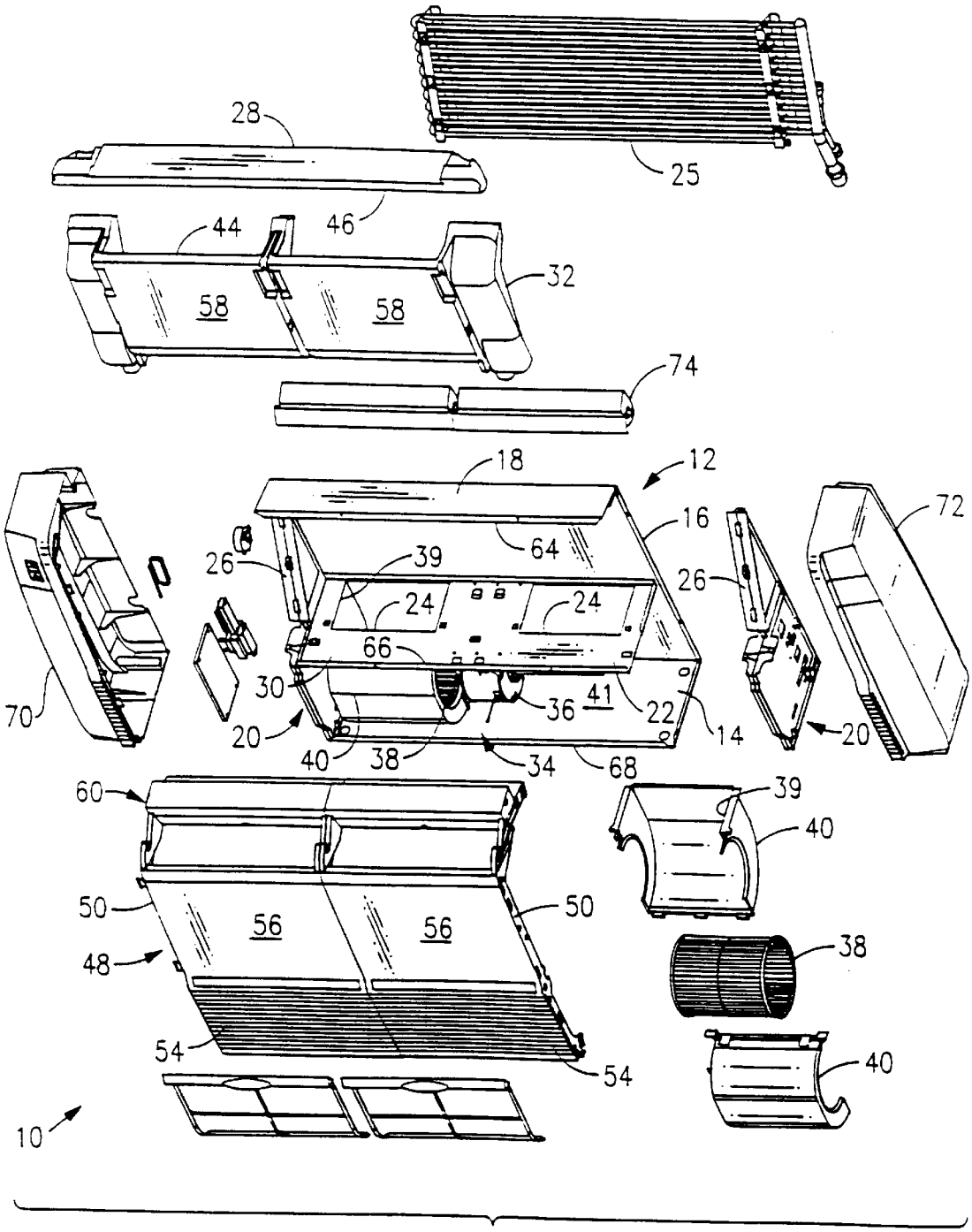
FIG. 10 is a perspective exploded view of the air conditioning unit of FIG. 1.

FIG. 1 illustrates an indoor unit 10 of a split system air conditioner of the type which is designed to be built in a variety of widths ranging from a narrow compact unit up to a unit many times wider than the compact unit, but having the same height as the compact unit. FIG. 10 is an exploded view of the unit of FIG. 1 and, with reference to FIGS. 1 and 10, the major structural and functional components of the unit will be briefly described. It should be appreciated, however, that while the invention will be described in detail with regard to an indoor unit of an air conditioner, the invention is broad and lends itself to application to other appliances and equipment, residential, commercial and industrial, which may be built in a variety of different lengths. The terms "appliance", where used in the description and claims, is meant to encompass such applications as well as any application requiring a component which requires assembly in different widths such as, for example, a door of a storage compartment or the like.

With reference to FIGS. 1 and 10, the unit 10 includes a main structural support frame 12, which includes a bottom panel 14, a back panel 16, and a top section 18. Attached to the sides of the back and top panels are structural internal side covers 20. The side covers 20 and the back panel 16 cooperate to support a horizontally extending fan support panel 22, which includes a pair of rectangular openings 24 formed therein. Mounted above the fan support panel 22 on a pair of inclined surfaces 26 defined by the internal side covers 20 is a heat exchanger coil 25.

Mounted under the top section 18 of the main support frame 12 is an upper condensate collection pan 28. Mounted in the front of the unit on the front edge 30 of the fan support panel 22 and spaced from the heat exchanger coil 25 is a bottom condensate collection pan 32.

Mounted to the lower surface of the fan support panel 22 is a fan assembly 34, which includes an electric motor 36 adapted to drive a pair of centrifugal fans 38, which are each enclosed in a two-piece scroll housing 40. Each of scroll housings 40 defines a rectangular upper air outlet opening 39, which is in air flow communication with the rectangular openings 24 in the fan support panel 22.

As a result of the above-described arrangement of components, when the fan assembly is energized, air is drawn into the region 41 underlying the fan support panel 22 through the open front and is directed upwardly through the rectangular openings 24, through the heat exchange coil 35, and is discharged through an opening 42 defined by the upper edge 44 of the lower condensate pan 32 and the front edge 46 of the upper condensate pan 28.

Reference numeral 48 refers generally to a front and top cover section assembled from two separate modular panels 50, according to the principles of the present invention. Each modular panel 50 generally comprises a planar front section 52, which includes a lower louvered portion 54, which is in fluid air communication with the region 41 underlying the fan panel to thereby define the air inlet to the unit. A solid section 56 of the planar front panel overlies a planar front section 58 of the lower condensate pan 32. Extending rearwardly from the upper end of the planar front section 52 of each modular panel 50 is a top section 60, which defines a rectangular air discharge opening 61, which overlies the discharge opening 42, described hereinabove. The top section 60 also includes a substantially horizontally extending section 62, which overlies and covers the top 18 of the main structural support 12. The front cover 48 is attached to the unit by means of threaded fasteners interconnecting the upper horizontal section 62 with a flange 64 on the top 18 of the main structural support and by additional threaded fasteners interconnecting the front cover with a flange 66 on the front of the fan panel 22 and a flange 68 provided on the front of the bottom 14 of the main structural support.

Left and right external side covers 70 and 72, respectively, are suitably attached to the internal side covers 20 and the left and right-hand sides of the cover assembly 48. An air discharge louver assembly 74 is mounted in the air discharge opening 61.

As mentioned above, the cover assembly 48, as illustrated in FIGS. 1, 4, 5 and 10, is assembled from two separate modular panels 50. As will seen, each of the modular panels 50 is identical and may be easily attached to additional modular panels to form a cover panel of a desired number of modules. The description of the modular panel 50 will be facilitated by reference to left and right-hand sides of the module. Because many of the drawing figures show the module from the back side, a convention has been adopted for purposes of clarity of the explanation wherein the left and right orientation refers to the panels as viewed in FIGS. 1, 5 and 10. In order to avoid confusion in FIGS. 2, 3, 4 and 7–9, which illustrate the modular panels 50 and their features from the back side, the capital letters are "R" and "L" have been added to these figures to remind the reader that this convention has been adopted.

Figure 2:
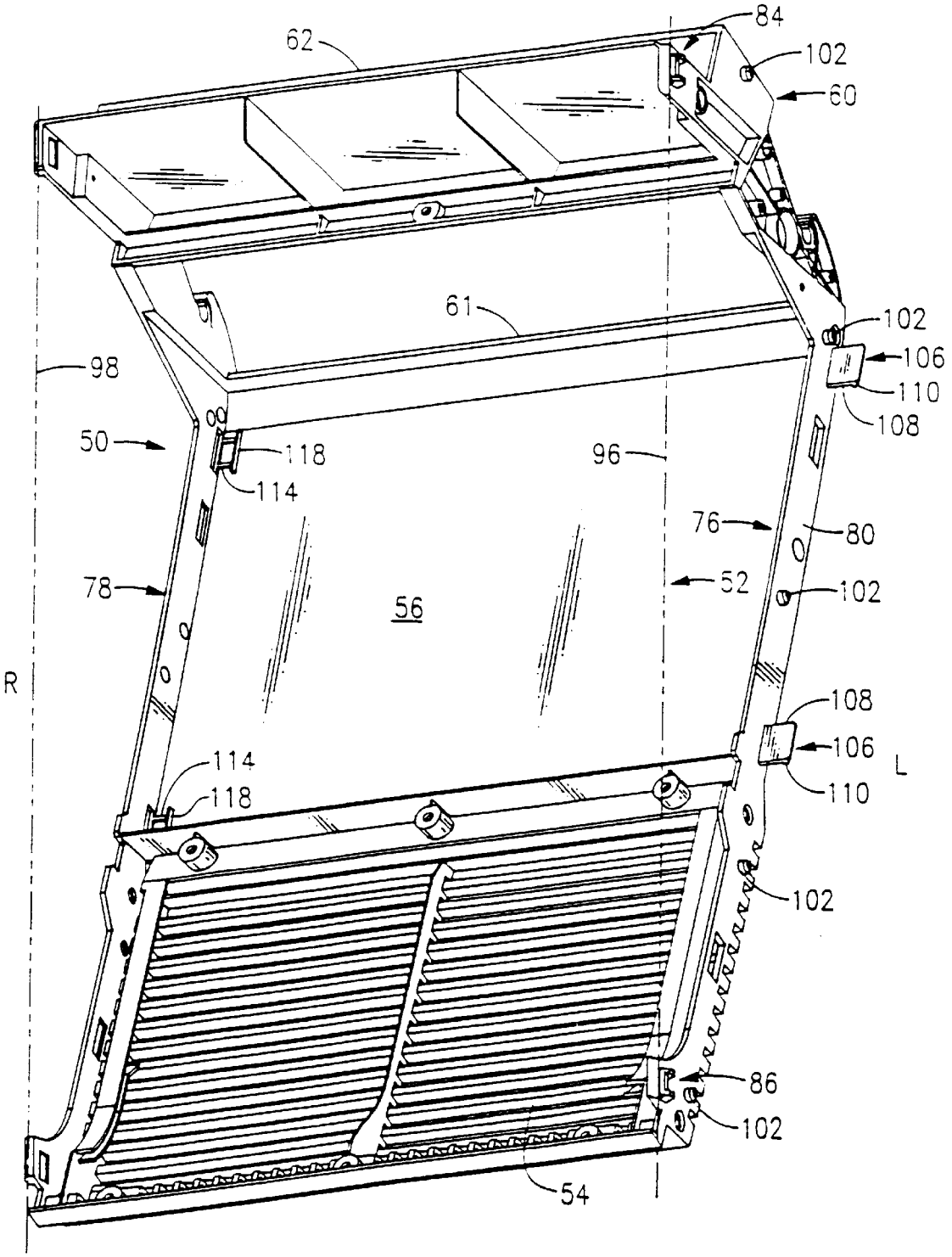
FIG. 2 is an enlarged perspective rear view of a modular front panel according to the present invention showing the details of the left-hand side of the panel.
Figure 3:
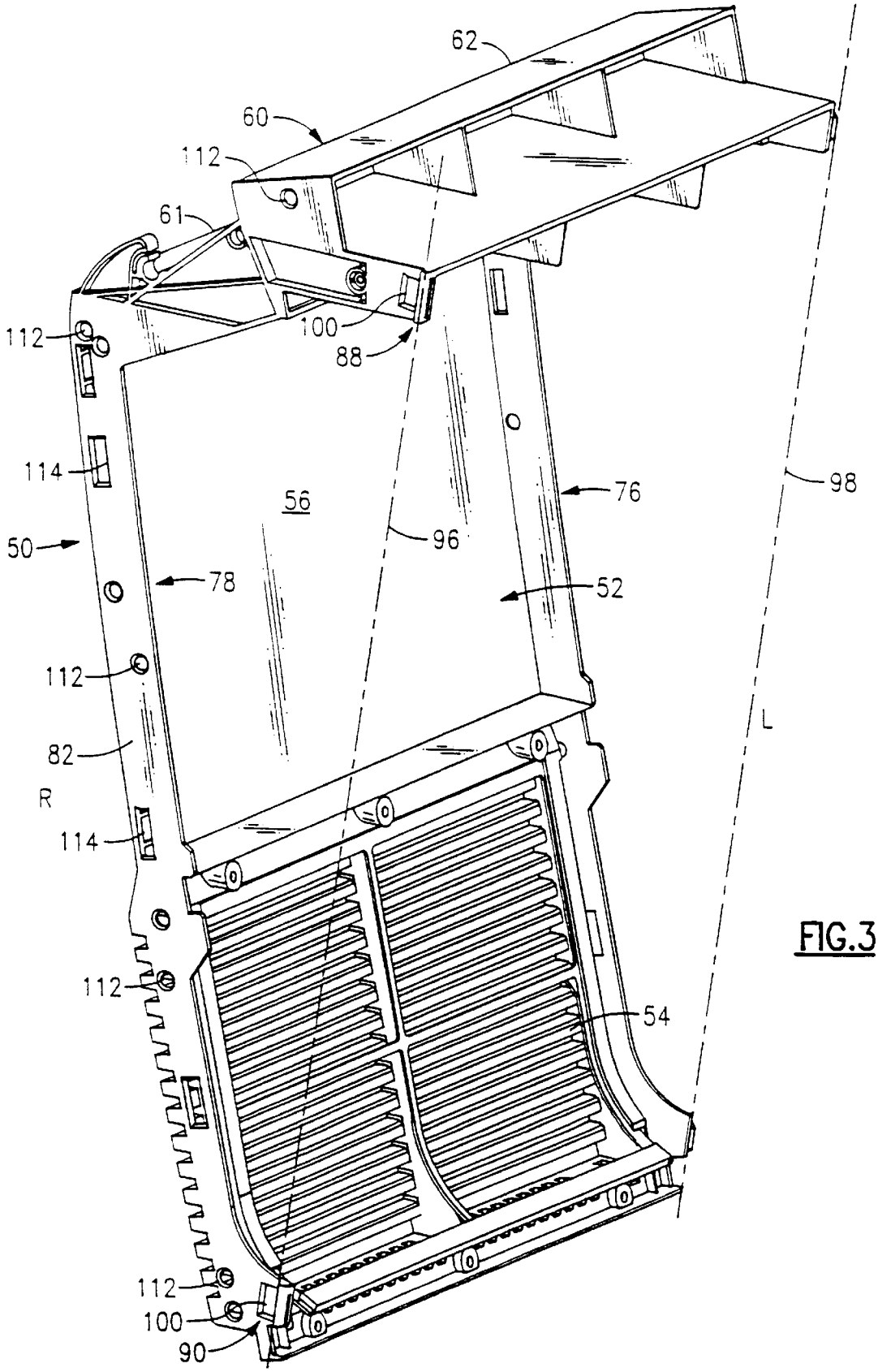
FIG. 3 is an enlarged perspective rear view of a modular front panel according to the present invention showing the details of the right-hand side of the panel.

Looking now at FIGS. 2 and 3, the left-hand side of the modular panel 50 includes a flange 76 integrally formed with the left-hand edge thereof, which extends rearwardly and substantially perpendicular to the planar front section 52 and the horizontally extending section 60. In a like manner, the right-hand side of the modular panel 50 includes a second flange 78 integrally formed with the right-hand edge of the module panel 50 and extending parallel to the first flange 76 and having the same relationship with the planar front section 52 and the horizontal cross section 60.

Figure 5:
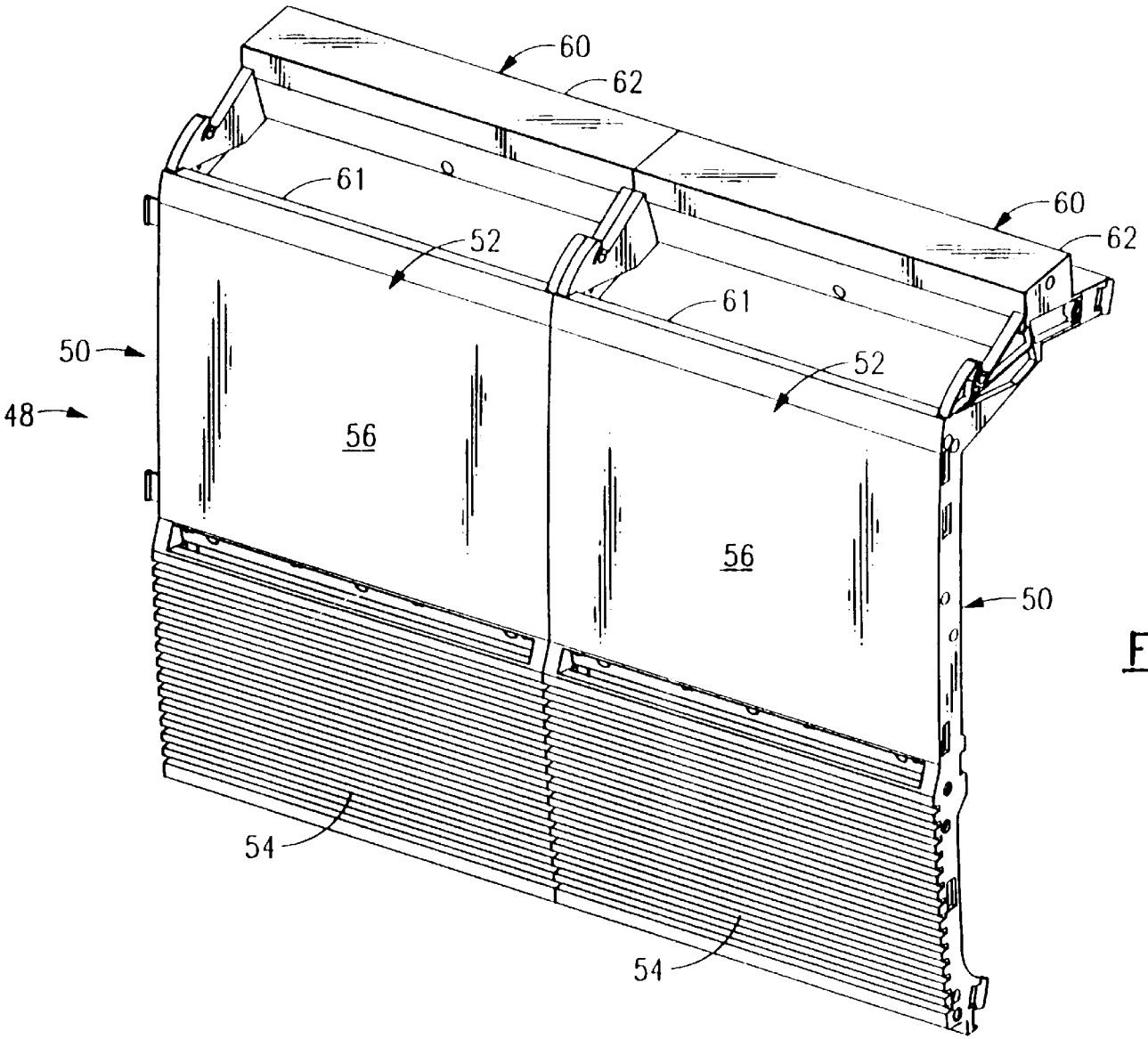
FIG. 5 is a perspective front view of two modular front panels fully assembled to one another.

As will be seen, with the exception of the mating attachment and alignment structure carried thereby, the flanges 76 and 78 are substantially identical and the outer surfaces 80 and 82, respectively thereof, are designed to be in confronting relationship with one another when a pair of modular panels 50 are assembled to one another, as illustrated in FIG. 5.

Looking now at the left-hand side, as best shown in FIG. 2, the flange 76 is provided with a pair of hook elements 84 and 86 extending outwardly from the outer surface 80 of the flange 76 at the upper and lower ends, respectively thereof. In a like manner, as best shown in FIG. 3, the outer surface 82 of the right-hand flange 78 is provided with integrally formed fixed pin elements 88 and 90 at the upper and lower ends thereof, respectively.

Figure 9:
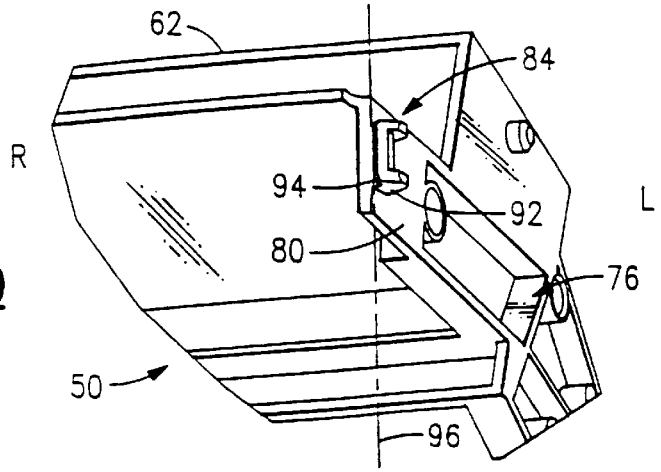
FIG. 9 is an enlarged detailing of the detail identified as FIG. 9 in FIG. 4.

The hook elements 84 and 86, one of which is shown in detail in FIG. 9, have a first portion 92 which extends outwardly from the outer surface 80 and a second latching portion 94, which extends rearwardly from the section 92 in a direction parallel to the outer surface 80. As best shown in FIGS. 2, 3 and 9, the upper and lower hook elements 84 and 86 each define a longitudinally extending pivotal axis which is coincidental with the axis of the other of the hook elements, as represented by reference numeral 96.

Figure 7:
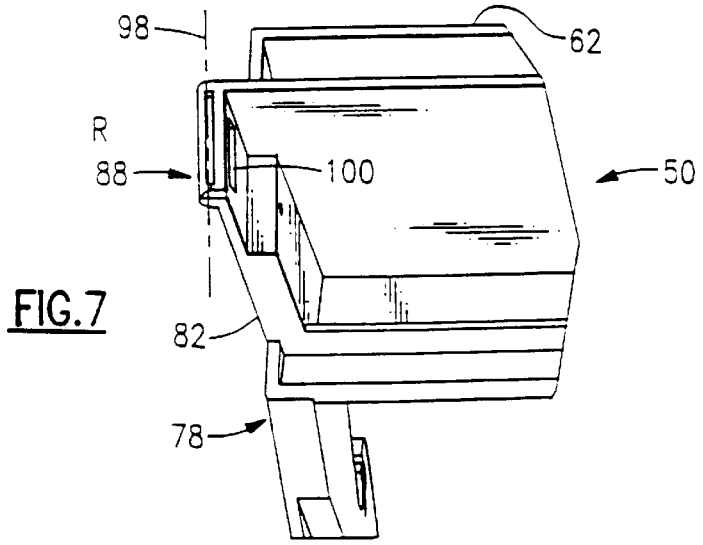
FIG. 7 is a enlarged view of the detail identified as FIG. 7 in FIG. 4.

In a similar fashion, as best shown in FIGS. 2, 3, and 7, the pins 88 and 90 extend longitudinally along a common axis 98. The pins 88 and 90 are supported at the extreme outer ends of the right-hand flange 78 and a rectangular clearance opening 100 is provided in each flange 78 forwardly of each of the pins. The axes 96 and 98 are parallel to one another and the pairs of hooks 84 and 86 and the pairs of pins 88 and 90 are equidistantly spaced from one another along their respective axes.

Figure 4:
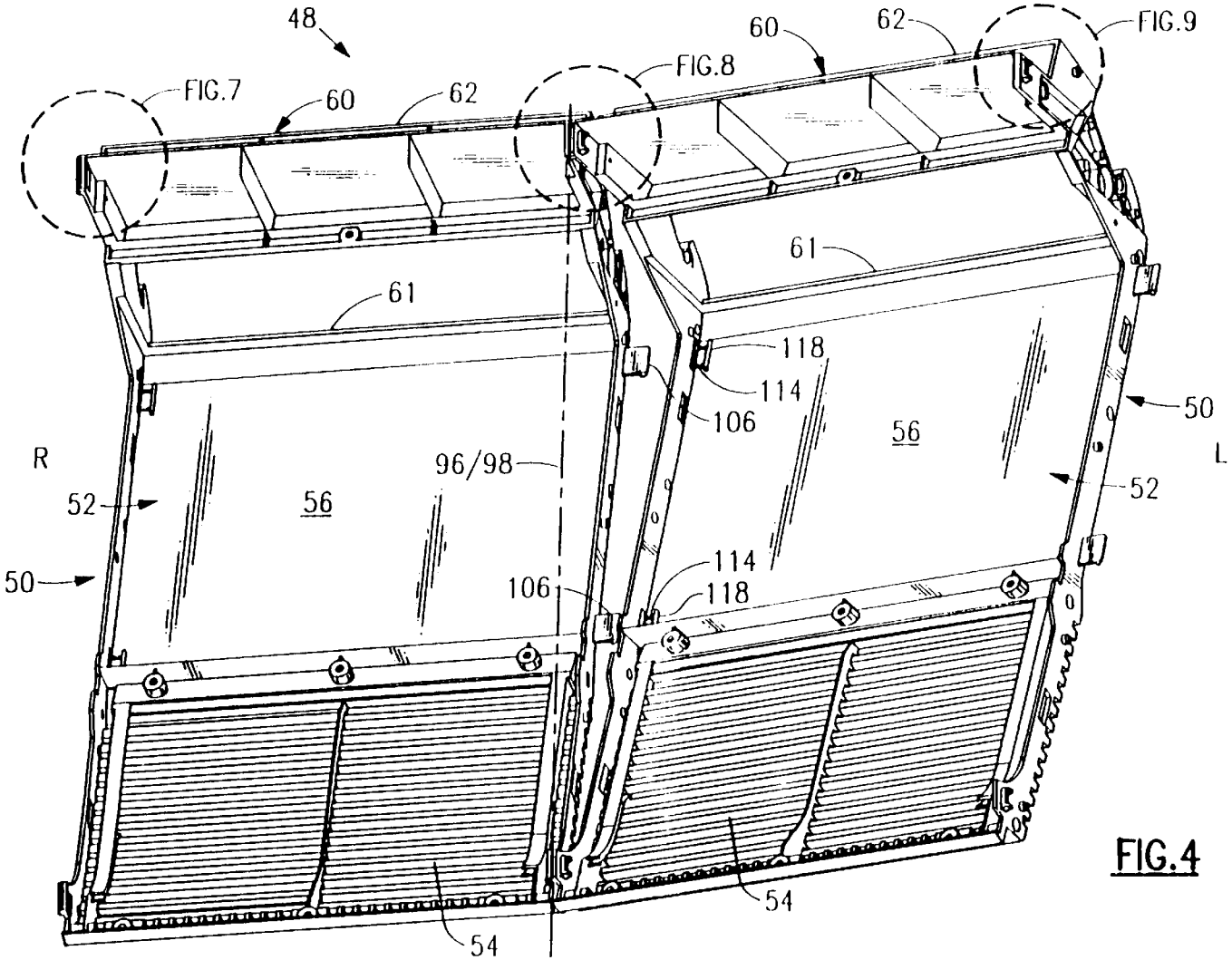
FIG. 4 is a perspective rear view of two modular front panels showing their initial engagement about a common axis prior to assembly to one another.
Figure 8:
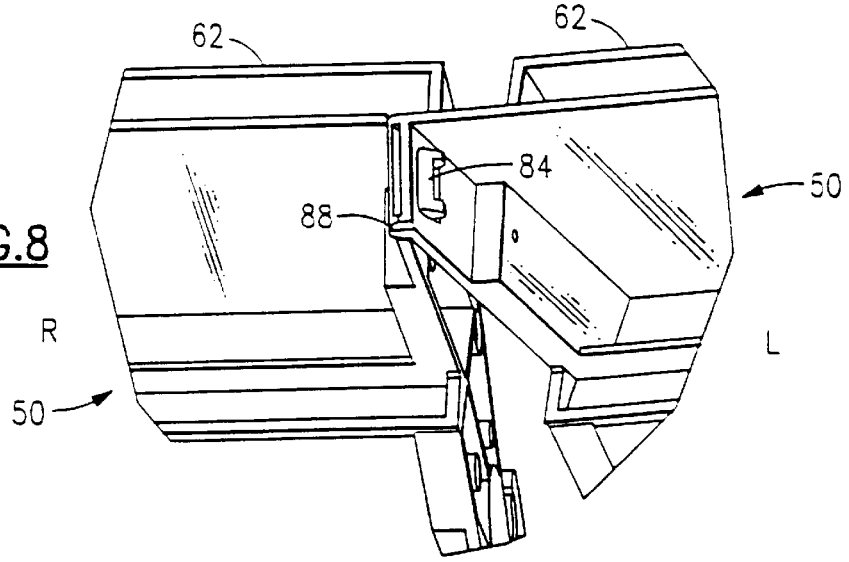
FIG. 8 is an enlarged view of the detail identified as FIG. 8 in FIG. 4.

Looking now at FIG. 4, assembly of one modular panel 50 to another is very simply achieved by engaging the upper and lower hook elements 84 and 86 on the right-hand side of module with the mating upper and lower pins 88 and 90 on the left-hand side of another module. With detailed reference to FIG. 8, such engagement is achieved by orienting the modules with the center portion of the outer surfaces 80 and 82 of the left and right-hand flanges 76 and 78 in spaced relationship with one another so that the upper and lower hook elements 84 and 86 are allowed to pass through the openings 100 associated with the upper and lower pins 88 and 90. Once the hooks and pins are engaged, as illustrated in FIGS. 4 and 8, the longitudinal axis 96 of the hooks and the longitudinal axis of the 98 of the pins are coincident. Following such engagement, the modules 50 are pivoted forwardly with the hook-pin engagements allowing rotation about the common axis until the outer surfaces 80 and 82 of the flanges 76 and 78 are in confronting assembled relationship, as illustrated in FIG. 5.

As thus assembled, adjacent modules are held in fixed relationship with one another by aligning and attaching a structure, which will now be described.

Looking first at FIG. 2, the outer surface 80 of the left-hand flange 76 is provided with five outwardly extending alignment pins 102 spaced substantially equidistant along the length of the flange. Also extending outwardly from the outer surface 80 of the left-hand flange 76 at locations lined up substantially with the top and bottom of the solid section 56 are two flexible latches 106. Each of the latches has an elongated flex section 108, which is integrally molded with the flange, and an outer latching head 110.

Referring now to FIGS. 3 and 4, the right-hand flange 78 is provided with five tapered openings 112 therethrough, which are adapted to receive the alignment pins 102 carried by the right-hand flange 76. The right-hand flange is also provided with two rectangular openings 114 positioned so as to allow the flexible latches 106 to pass therethrough when a pair of modules are assembled. Located on the inside of the solid section 56 adjacent the openings is a latching structure 118 adapted to engage the flexible latches 106 causing the flex section 108 to flex outwardly as a pair of modules are assembled and to allow the flex sections to then flex inwardly with the latching head 110 in fixed engagement therewith to thereby hold a pair of assembled modules in the assembled aligned position, as illustrated in FIG. 5.

Figure 6:
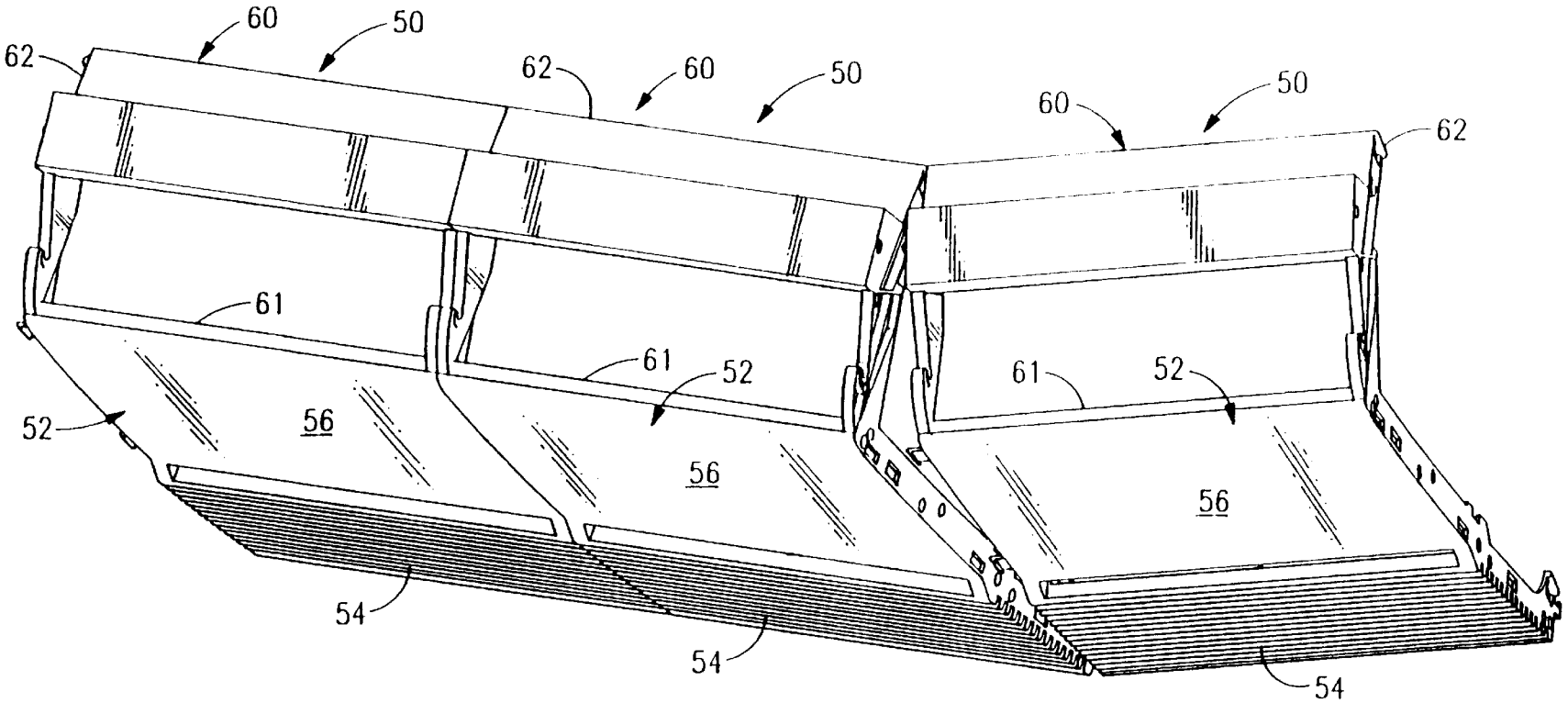
FIG. 6 is a front perspective view illustrating two modular front panels fully assembled to one another and a third panel partially assembled thereto.

It should be appreciated that each of the modules 50 is identical and that a third or additional modules may be assembled to either side of an assembled pair as illustrated in FIG. 6 to thereby achieve a panel having the desired length.

It should be appreciated that the assembly of the modules forming the front panel of the indoor air conditioning unit 10 are assembled to one another in a final structural arrangement without the need for any separate fastening means such as screws or clips or the like. It should further be appreciated that the labor involved in assembling such modules to one another is minimal and does not require the manipulation of any tools either manual or power operated.

What is claimed is:

1. A modular panel forming part of an enclosure for an appliance, the appliance being manufacturable in a plurality of sizes requiring two or more of said panels, each of said panels comprising:

a main section defining a front surface and a rear surface and first and second substantially parallel spaced apart edges;

said main section further comprising a first substantially planar section and a second section extending angularly rearwardly from said first section;

a first flange integrally formed with said first and second sections of main section and extending rearwardly from said first edge and defining a rear edge;

a second flange integrally formed with said first and second sections of said main section and extending rearwardly from said second edge and defining a rear edge;

said first and second flanges extending substantially parallel to one another and each having an inner facing surface and an outer facing surface;

said outer facing surface of said first flange having integrally formed, at the rear edge thereof, at least two first hinge elements, spaced from one another by a predetermined distance, which together define a first axis, one of said first hinge elements being adjacent said first section and another of said hinge elements being adjacent said second section;

said outer surface of said second flange having integrally formed, at the rear edge thereof, at least two second hinge elements spaced from one another by the same predetermined distance as said first hinge elements, one of said second hinge elements being adjacent said first section and the other of said second hinge elements being adjacent said second section, and together defining a second axis parallel to said first axis;

said second hinge elements being configured to joiningly engage said first hinge elements of another substantially identical modular panel in a manner which causes said first and second axes to become coincident and allows pivotal movement of said panels with respect to one another about said coincident axes until said outer surfaces of said first flange of said first modular panel is in confronting relation with said outer surface of said second flange of said another modular panel; and means for interconnecting said confronting outer surfaces to one another.

2. The apparatus of claim 1 wherein said outer surface of one of said first or second flanges includes a plurality of outwardly extending protuberances; and wherein the outer surface of the other flange includes recesses configured to receive each of said plurality of protuberances on said outer surface of said one of said flanges; and wherein said means for interconnecting comprises at least one outwardly extending flexible latch formed on the outer surface of said one flange; and openings formed in said other flange, said openings being configured to allow said latch means to extend through said openings; and latch engaging conformations on the inner surface of said main section proximate said openings which is configured to cooperate with said latch means to thereby interconnect one adjacent panel to another panel.

* * * * *